United States Patent [19]

Brown

[11] 4,387,669

[45] Jun. 14, 1983

[54] HEATER

[75] Inventor: Billy G. Brown, Levelland, Tex.

[73] Assignee: Murrell's Welding Works, Inc., Levelland, Tex.

[21] Appl. No.: 362,913

[22] Filed: Mar. 29, 1982

[51] Int. Cl.[3] ..... F22B 29/02

[52] U.S. Cl. ..... 122/235 A; 122/13 R; 122/15; 122/19

[58] Field of Search ..... 122/18, 19, 15, 235 R, 122/235 A, 235 C, 235 K, 6 A, 13 R

[56] References Cited

U.S. PATENT DOCUMENTS

| | | | |
|---|---|---|---|
| 1,023,450 | 4/1912 | Wheller | 122/19 |
| 1,779,937 | 10/1930 | Holinger | 122/13 R |
| 3,707,142 | 12/1972 | Kobayashi | 122/13 R |
| 4,290,388 | 9/1981 | Ruhe et al. | 122/235 C |
| 4,359,951 | 11/1982 | Dauvergne | 122/15 |
| 4,361,276 | 11/1982 | Paige | 122/19 |

FOREIGN PATENT DOCUMENTS

| | | | |
|---|---|---|---|
| 1263530 | 5/1961 | France | 122/235 K |
| 148611 | 7/1920 | United Kingdom | 122/18 |

*Primary Examiner*—Henry C. Yuen
*Attorney, Agent, or Firm*—Wendell Coffee

[57] ABSTRACT

A portable oil field heater heats a liquid water-petroleum mixture by passing it through a single continuous path primary coil, and then a single continuous path secondary coil. The continuous path primary coil extends along the walls of the heater, and the secondary coil is a bundle above an LPG burner. The air for combustion is introduced from the top of the heater through false walls to beneath a false floor beneath the burner. Thus, it is not necessary to have insulation (particularly fire brick) along the sides of the heater; thereby greatly reducing weight and maintenance. The safety of the unit is greatly improved by introducing the combustion air from a height well above the level of the burner.

12 Claims, 4 Drawing Figures

HEATER

CROSS REFERENCE TO RELATED APPLICATIONS

None, however, applicant filed Disclosure Document No. 104,842 on Dec. 14, 1981, which document concerns this application; therefore, by separate paper it is respectfully requested that the document be retained and acknowledgement thereof made by the Examiner.

BACKGROUND OF THE INVENTION

1. Field of the Invention

This invention relates to heaters and more particularly to a portable oil field heater with the walls both water cooled and air cooled.

2. Description of the Prior Art

Before this invention, heaters were mounted upon skids for transportation or upon the beds of trucks, and were used in the oil field to heat mixtures of petroleum and water. Also, heaters were used to heat oil alone. Normally, the walls of the heater were insulated by fire block, which rapidly deteriorated due to the rough roads and rough handling to which the heaters were subjected.

Before this application was filed, a search was made in the U.S. Patent and Trademark Office. That search developed the following U.S. patents:

Stewart: U.S. Pat. No. 1,980,301
Thomas: U.S. Pat. No. 2,079,191
Hassler et al: U.S. Pat. No. 2,081,927
Schlenz: U.S. Pat. No. 2,586,998
Olson et al: U.S. Pat. No. 2,699,155
Richardson: U.S. Pat. No. 3,119,438
Coggins et al: U.S. Pat. No. 4,289,093
Ruhe et al: U.S. Pat. No. 4,290,388

These patents are considered pertinent because the applicant believes the Examiner would consider anything returned by the searcher to be relevant and pertinent to the examination of this application.

It is noted that Stewart discloses an oil heater mounted upon a truck.

SUMMARY OF THE INVENTION

(1) New and Different Function

I have invented a new heater having the walls both water cooled and air cooled, which has many benefits. The maintenance on this heater is particularly low because of the absence of any insulation, except beneath the floor of the heater. In addition to the heater being cheaper to build, lighter in weight, it is also safer and has good thermal efficiency.

Besides having the walls liquid cooled, also the walls are cooled by the air being blown from the top of the heater through false walls, which are outside of the liquid cooled walls. This not only cools the walls, but also preheats the air for combustion.

Thus it may be seen that the function of the total combination, far exceeds the sum of the functions of the individual elements such as pipes, burners, blowers, etc.

(2) Objects of this Invention

An object of this invention is to heat liquids.

Further objects are to achieve the above with a device that is sturdy, compact, durable, lightweight, simple, safe, efficient, versatile, ecologically compatible, energy conserving, and reliable, yet inexpensive and easy to manufacture, move, adjust, operate and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENT

Figure 3:
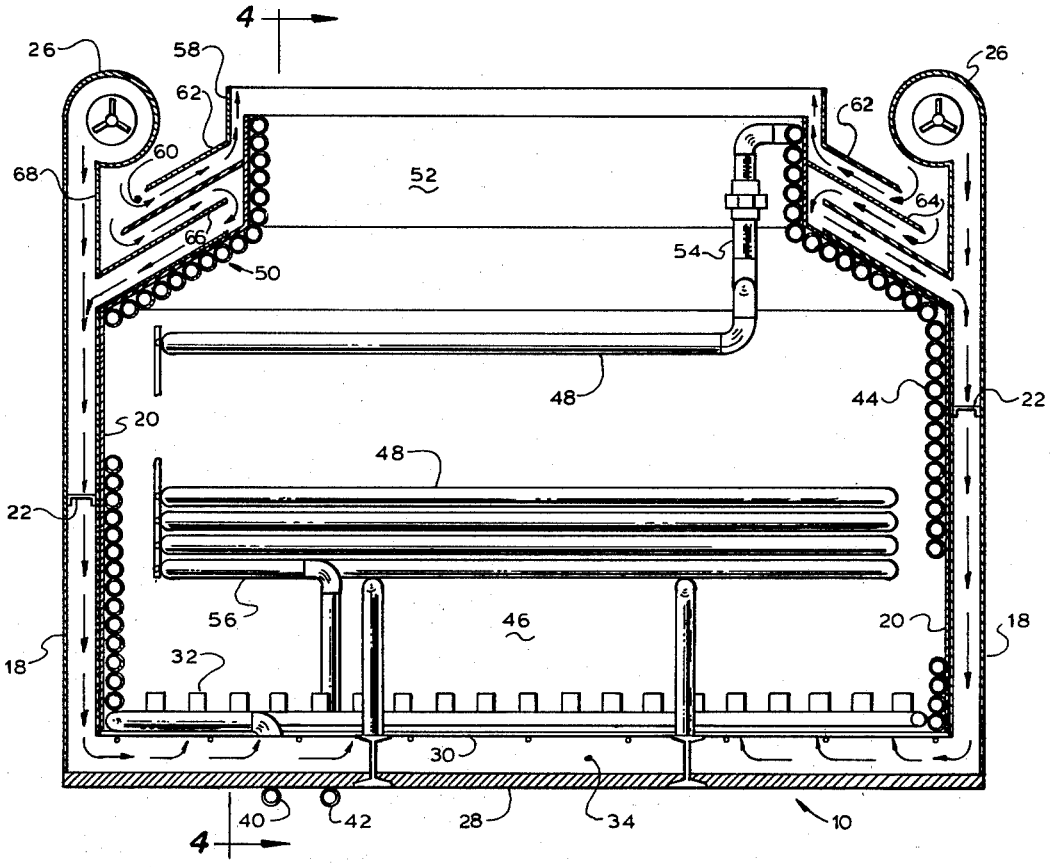
FIG. 3 is a side sectional view of the heater.
Figure 1:
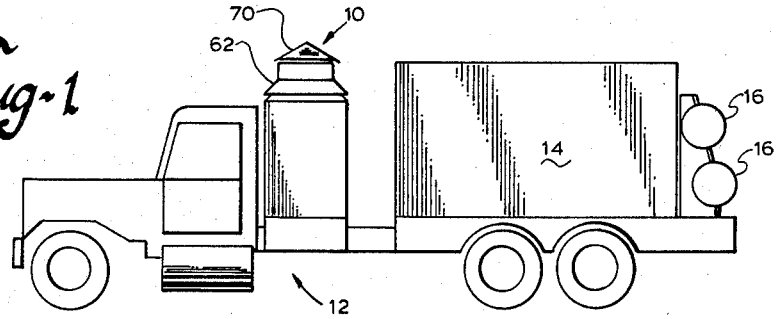
FIG. 1 is a perspective view of a heater according to my invention mounted upon a truck.
Figure 2:
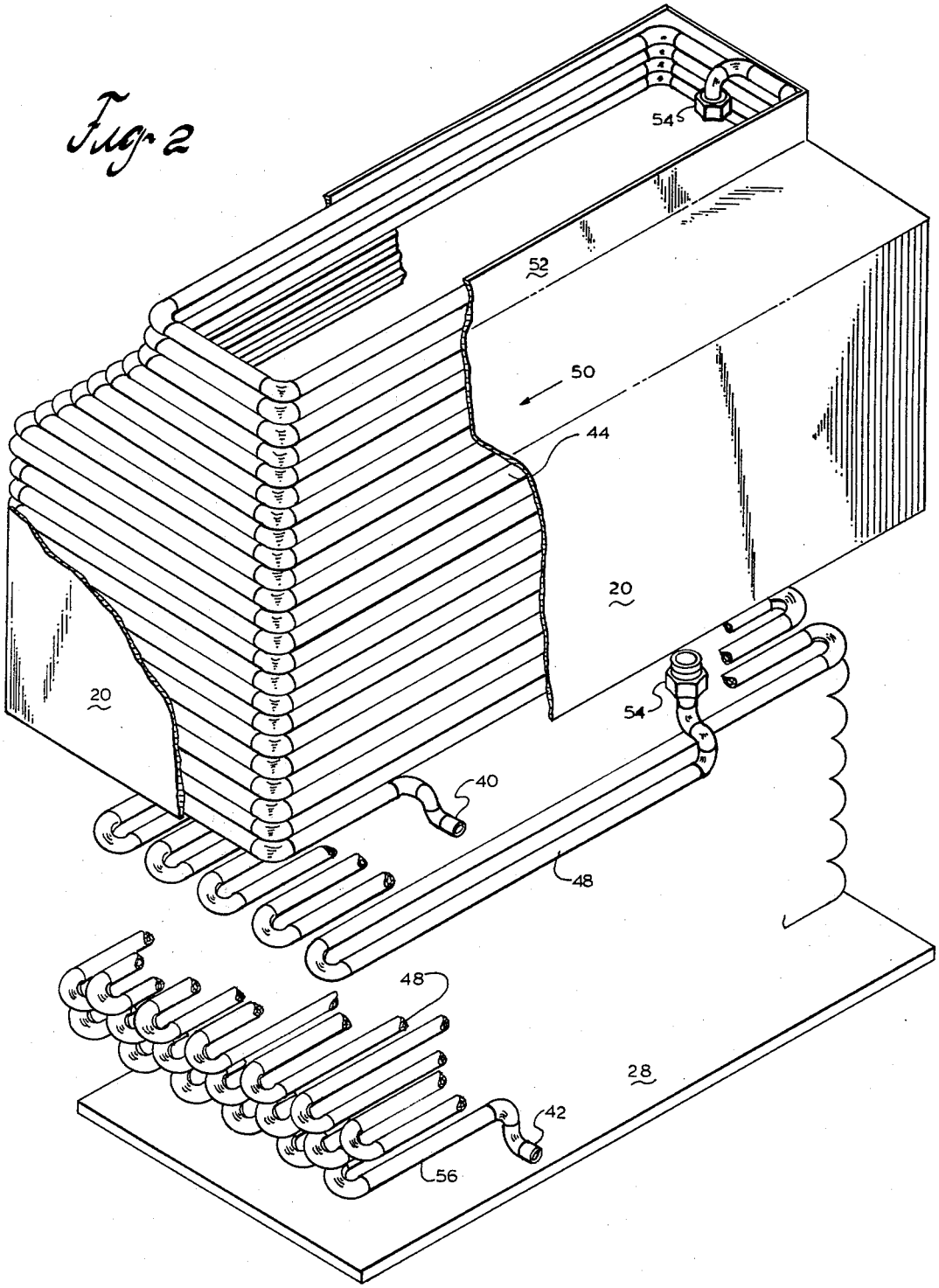
FIG. 2 is a perspective exploded view of the coils of the heater broken away for clarity of illustration.
Figure 4:
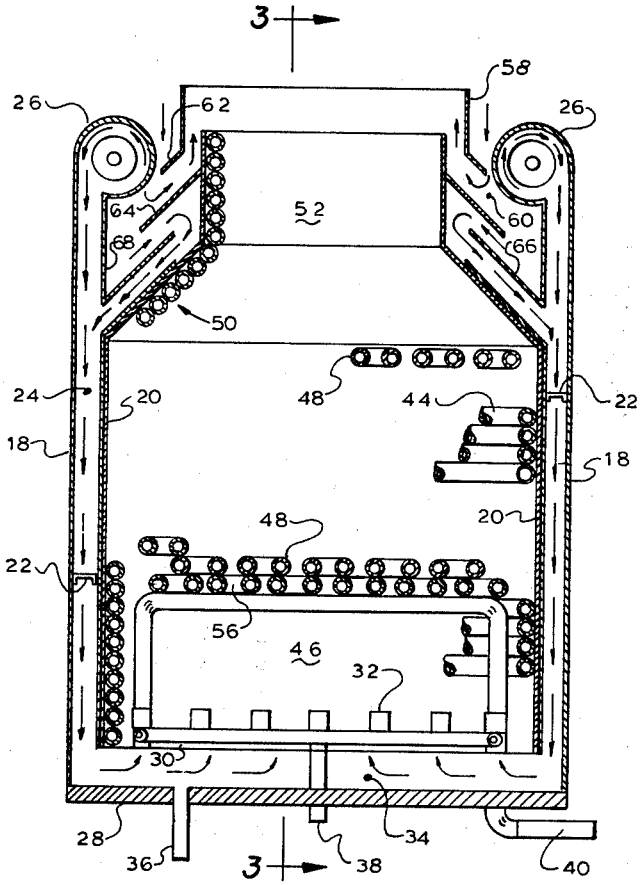
FIG. 4 is an end sectional view of the heater.

FIG. 1 discloses an embodiment of heater 10 mounted upon truck 12. Liquid tank 14 and fuel tank 16 are also mounted upon the truck 12. As seen, and more particular in FIGS. 2, 3, and 4, the heater itself is basically a four-sided box having an outer wall or shell 18. The outer wall or shell 18 is conveniently made of steel and encases sleeve 20. Suitable spacers 22 are used to space the outer wall 18 from the sleeve 20 so as to form an air passageway or airway 24 between the two.

Blower 26 is located at the top of each of the four outer walls 18. These blowers or fans, blows air into the airways 24 between the outer walls 18 and the sleeve 20.

Outer floor 28 is insulated. Inner floor 30 is supported above the outer floor 28. Burners 32 are mounted above the inner floor 30. The inner floor 30 is perforated to permit the air to pass from bottom airway 34 through the perforations to provide combustion air for the burners 32. Condensate drain 36 extends through the outer, insulated floor 28 to drain any moisture which might condense within the heater during periods of non-use.

Fuel inlet 38 extends through the outer shell 18 and sleeve 20 to provide fuel to the burners 32.

If the outer elements are considered a housing, it may be seen that there is a housing having the closed outer floor 28, which is joined to the four closed outer walls 18.

As used herein, liquid is meant to be that product which is heated by the heater. Usually the liquid being heated will be the liquid as produced by the oil well, which will include crude oil and water. However, on other cases, it may be that the liquid would be only oil.

Liquid inlet 40 and liquid outlet 42 also extend through both the outer wall 18 and the sleeve 20. Condensate drain 36, fuel inlet 38, liquid inlet 40, and liquid outlet 42, each extend through the shell, or housing, near the junction of the outer floor 28 and one of the outer side walls 18.

The liquid inlet 40 connects to primary coil 44. The primary coil 44 is a continuous pipe, which includes legs which extend along the bottom of a first side and a first end and an opposite side and an opposite end and on around in a helical pattern from the bottom of the sleeve 20 to the top, as seen in the drawing. In this regard, the primary coil 44 could be thought of as the inner wall and the sleeve 20 merely a gas-tight sleeve therearound. The successive pipes of the primary coil are placed as close together as possible for construction purposes so that they effectively form a wall around firebox 46 of the heater 10. The firebox 46 being that space having the burners 32 at the bottom, the primary coil 44 around the four sides, and secondary coil 48 at the top.

The top of the primary coils 44 taper in at an area 50, so that a truncated pyramid is formed in this area. From there a few courses or successive loops of the helical pattern of the primary coil continue to form a short stack 52. Referring to FIG. 1, it may be seen that if the truck 12 is to meet highway standards, the height of the heater 10 is limited, and therefore an extended or tall stack is not possible. From the extreme top of the primary coil 44, connecting pipe 54 extends within the stack 52 to the top layer of the secondary coil 48.

The top of the secondary coil 48 is about at the bottom or slightly below the bottom of the taper area 50 of the primary coil 44. The secondary coil 48 is a bundle of pipe, which is spaced apart in layers; i.e. there are parallel, spaced-apart pipe extending in each layer, and there are successive layers or courses with the pipes between the layers staggered from one to the other. Again, there is a single, continuous conduit, or a single path for the passage of the liquid. By the term continuous, it is meant that there is only one flow path through the heater and that there are no T's, Y's, or dual paths. The secondary bundle continues to the bottom course or layer 56, which, as indicated above, forms the top of the firebox 46. The end of the secondary coil 48 is connected to the liquid outlet 42.

Those with ordinary skill in the art will understand that a great amount of the auxiliary equipment, such as thermostats, fuel control valves, liquid pumps, liquid control valves, pilot flames and the like have not been shown inasmuch as these elements are all conventional. Also, certain details of construction such as the saddles and support brackets for the secondary coil as well as the primary coil, have not been shown inasmuch as they are all within the skill of those having ordinary skill in the construction of equipment of this category.

Short outer stack 58 is attached by suitable clips to the sleeve 20 and outer shell 18. Airspace 60 is between the outer stack 58 and the shell 18. A short distal flange or baffle 62 extends outward from the bottom of the outer stack 58. Spaced below this is the sleeve baffle 64, which is attached to the sleeve 20, spaced from the flange 62 and also slopes downward as the flange 62. Fan baffle 66 is immediately below the sleeve baffle 64 and is attached to inner fan wall 68 as shown in the drawing. Therefore, in operation, a certain amount of induced air will enter through the airspace 60. A portion of this air will go between the flange 62 and the sleeve baffle 64 and be expelled along the interior perimater of the outer stack 58. Although this air will cool the very top of the sleeve 20 around the stack 52, the main purpose of this air is to form an air shield to prevent a total disruption of the exhaust gasses coming from the burners 32. Those skilled in the art of operating oil field heaters of this category, will understand that often the liquid within liquid tank 14 will be heated by the heater 10 while the truck 12 is moving from one location to another. Since there is this desirability of operating the heater in this manner, it is necessary that the wind does not disrupt the normal operation of the burners 32.

The remainder of the air entering through the airspace 60, will pass between the sleeve baffle 64 and the fan baffle 66 and then downward along the sleeve 20 to the airway 24. This air will be cooling air, which will cool the sleeve 20 along that portion of the sleeve which covers the stack 52 and also the taper area 50. The flange 62, sleeve baffle 64, and fan baffle 66 are all parallel to the sleeve 20 covering the taper area 50.

Rain cap 70 is pivoted to the outer stack 58 so that it may cover the opening in the outer stack when the truck 12 is stationary.

The embodiment shown and described above is only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

| | | | |
|---|---|---|---|
| 10 | heater | 42 | liquid outlet |
| 12 | truck | 44 | primary coil |
| 14 | liquid tank | 46 | firebox |
| 16 | fuel tank | 48 | secondary coil |
| 18 | outer wall (or shell) | 50 | taper area |
| 20 | sleeve | 52 | stack |
| 22 | spacers | 54 | connecting pipe |
| 24 | airway | 56 | bottom layer |
| 26 | blower | 58 | outer stack |
| 28 | outer floor | 60 | airspace |
| 30 | inner floor | 62 | flange |
| 32 | burners | 64 | sleeve baffle |
| 34 | bottom airway | 66 | fan baffle |
| 36 | condensate drain | 68 | inner fan wall |
| 38 | fuel inlet | 70 | rain cap |
| 40 | liquid inlet | | |

I claim as my invention:

1. An oil field heater for heating produced liquid comprising in combination:

a. a housing having
  (i) a closed floor, joined to
  (ii) four closed side walls, which are joined to
  (iii) a top with
  (iv) a short stack thereon, b. tubing forming a single path for liquids within the housing, said path being
  (i) from an inlet near the juncture of the floor and one of the side walls, into a primary coil which is
  (ii) helically around the side walls up to the stack,
  (iii) and from the top of the primary coil into the top of a secondary coil which is a bundle formed of
  (iv) a series of spaced apart horizontal layers,
  (v) each layer including a series of spaced apart tubes, and
  (vi) from the bottom of the secondary coil to an outlet near the junction of the floor and one of the side walls, c. said primary coil spaced from each of the four side walls thus forming four air passageways, one passageway between the primary coil and each of the four walls, and d. a blower at the top of each air passageway to blow combustion air to e. a burner located in f. a fire box above the floor and below the bottom of the secondary coil, g. so that the four side walls are separated from the fire box by the primary coil and the air passageways.

2. An oil field heater fitting the description of claim 1 including all the limitations a. through g. and also comprising:

h. a rain cap pivoted to the housing above the stack to prevent rain water from falling into the heater while not in use, and j. a condensate drain pipe extending through the floor.

3. An oil field heater fitting the description of claim 1 including all the limitations a. through g. and also comprising:

h. the blower inlets being at about the same elevation as the top of the primary coil which is about the elevation of the stack.

4. An oil field heater fitting the description of claim 1 including all the limitations a. through g. and also comprising:

h. a sheet metal sleeve snugly around the primary coil to prohibit flame leakage therefrom.

5. An oil field heater fitting the description of claim 1 including all the limitations a. through g. and also comprising:

h. additional space between the upper portion of the primary coil and the housing to provide an induced air passageway between the housing and the primary coil at the stack location.

6. An oil field heater fitting the description of claim 1 including all the limitations a. through g. and also comprising:

h. the floor being insulated, and j. the burners spaced above the floor so there is an air passageway between the burner and the insulated floor.

7. An oil field heater fitting the description of claim 6 including all the limitations a. through j. and also comprising:

k. additional space between the upper portion of the primary coil and the housing to provide an induced air passageway between the housing and the primary coil at the stack location.

8. An oil field heater fitting the description of claim 7 including all the limitations a. through k. and also comprising:

l. a sheet metal sleeve snugly around the primary coil to prohibit flame leakage therefrom.

9. An oil field heater fitting the description of claim 8 including all the limitations a. through l. and also comprising:

m. the blower inlets being at about the same elevation as the top of the primary coil which is about the elevation of the stack.

10. An oil field heater fitting the description of claim 9 including all the limitations a. through m. and also comprising:

n. a rain cap pivoted to the housing above the stack to prevent rain water from falling into the heater while not in use, and o. a condensate drain pipe extending through the floor.

11. An oil field heater fitting the description of claim 1 including all the limitations a. through g. and also comprising:

h. a truck with said heater mounted thereon, j. a liquid tank mounted on the truck, and k. a fuel tank mounted on the truck.

12. An oil field heater fitting the description of claim 10 including all the limitations a. through o. and also comprising:

p. a truck with said heater mounted thereon, q. a liquid tank mounted on the truck, and r. a fuel tank mounted on the truck.

* * * * *